United States Patent [19]

Rowe

[11] Patent Number: 4,524,598

[45] Date of Patent: Jun. 25, 1985

[54] METHOD OF ROLLING A SIMULATED HOLE IN SHEET METAL WITHOUT DRILLING OR PUNCHING

[75] Inventor: Neal E. Rowe, Asheville, N.C.

[73] Assignee: Westinghouse Electric Corp., Pittsburgh, Pa.

[21] Appl. No.: 540,067

[22] Filed: Oct. 7, 1983

[51] Int. Cl.[3] ..... B21B 1/08; B21D 53/36

[52] U.S. Cl. ..... 72/198; 72/177; 72/379; 29/150; 411/427; 52/364

[58] Field of Search ..... 72/192, 194, 198, 184, 72/177, 379; 29/163.5 R, 150, 11; 411/427, 548; 52/364, 710

[56] References Cited

U.S. PATENT DOCUMENTS

| | | | |
|---|---|---|---|
| 481,207 | 8/1892 | Smith | 29/11 |
| 1,801,559 | 4/1931 | Kellogg | 29/11 |
| 1,842,678 | 1/1932 | Kreuzeder | 72/379 |
| 1,874,732 | 8/1932 | Young | 29/11 |
| 2,004,700 | 6/1935 | Laemmel | 29/150 |
| 3,020,631 | 2/1962 | Kennedy | 29/150 |
| 3,792,560 | 2/1974 | Naylor | 52/364 |

FOREIGN PATENT DOCUMENTS

| | | | |
|---|---|---|---|
| 10693 | 2/1903 | Austria | 29/150 |

*Primary Examiner*—Daniel C. Crane

[57] ABSTRACT

A method of fabricating sheet metal is described wherein a simulated opening for a threaded fastener is formed in sheet metal solely by roll forming a U-shaped loop segment in the sheet metal and then creating a simulated opening therein by crimping the sheet metal around a pin removably inserted in the loop segment. The simulated opening or hole is of sufficient depth to accommodate the entire length of the fastener and is formed without any drilling or punching operations.

4 Claims, 4 Drawing Figures

METHOD OF ROLLING A SIMULATED HOLE IN SHEET METAL WITHOUT DRILLING OR PUNCHING

BACKGROUND OF THE INVENTION

1. Field of the Invention

This invention relates generally to sheet metal fabrication and more particularly to a method of providing simulated holes in sheet metal without drilling or punching.

2. Description of the Prior Art

In fabricating structures from sheet metal such as enclosures for electrical apparatus there is a cost motivation to reduce the sheet metal gauge to the smallest practical metal thickness. Structural strength is typically attained by folding the thin sheet metal. Where column strength is required, as in a corner, the sheet metal may have a multi-bend, or convoluted final shape. A commonly used manufacturing method is "roll forming", where sheet metal passes through groups of rollers in series, to gradually create the shapes required. Using mechanical screw fasteners in fabrication presents a problem because the sheet metal is not thick enough to provide the necessary threads to anchor the fastener in place. Screw and nut combinations are required which increases the cost of fabrication.

SUMMARY OF THE INVENTION

There is provided by this invention method of creating a simulated hole in thin sheet metal. An immediate advantage is thus obtained since the simulated hole provides a full depth hole of the proper diameter to provide screw threads for the entire length of the fastener screw and thus firmly hold it in place.

DESCRIPTION OF THE PREFERRED EMBODIMENTS

Figure 1:
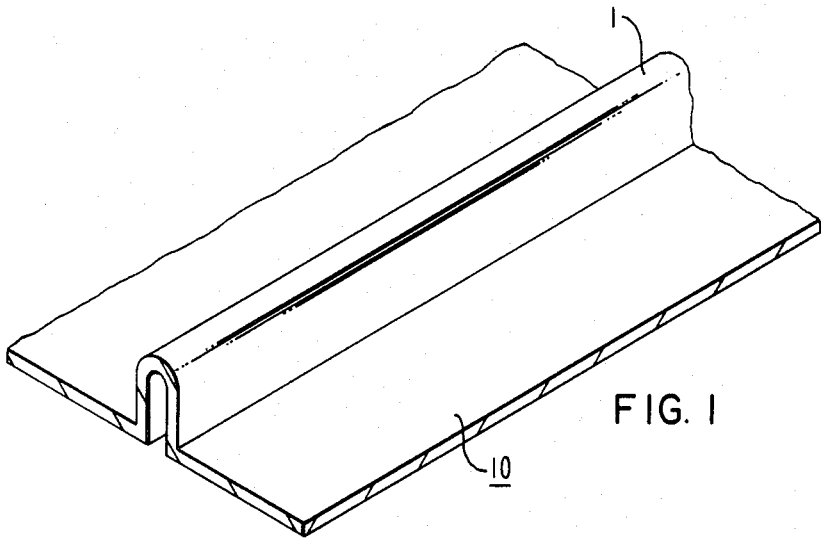
FIG. 1 illustrates the first step incorporating the principles of this invention.

Referring to FIG. 1 there is shown the first step of the method of forming a simulated hole in sheet metal which consists of roll forming an upstanding U-shaped loop segment 1 in the sheet metal 10 of a width and depth to match the diameter and grip length of the screw or other threaded fastener to be anchored in the sheet metal 10.

Figure 2:
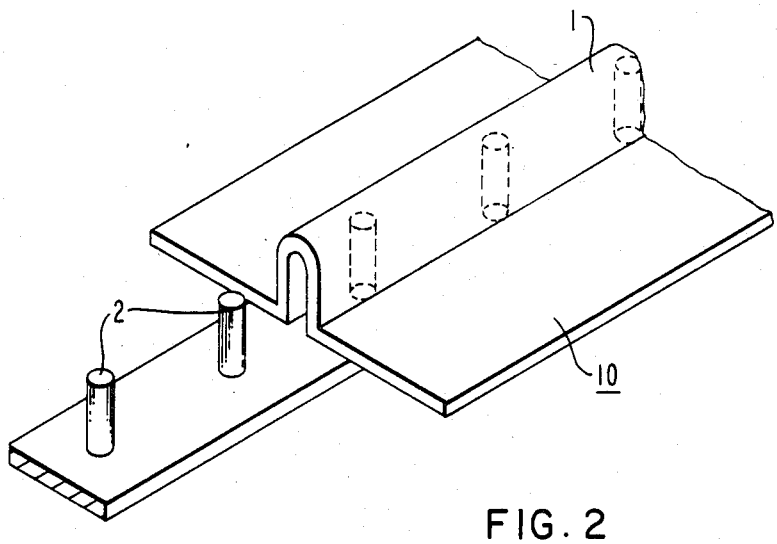
FIG. 2 illustrates the second step.

FIG. 2 illustrates the second step which consists of inserting removable pins 2 into the loop segment 1 of the sheet metal 10 at intervals where screw holes are desired.

Figure 3:
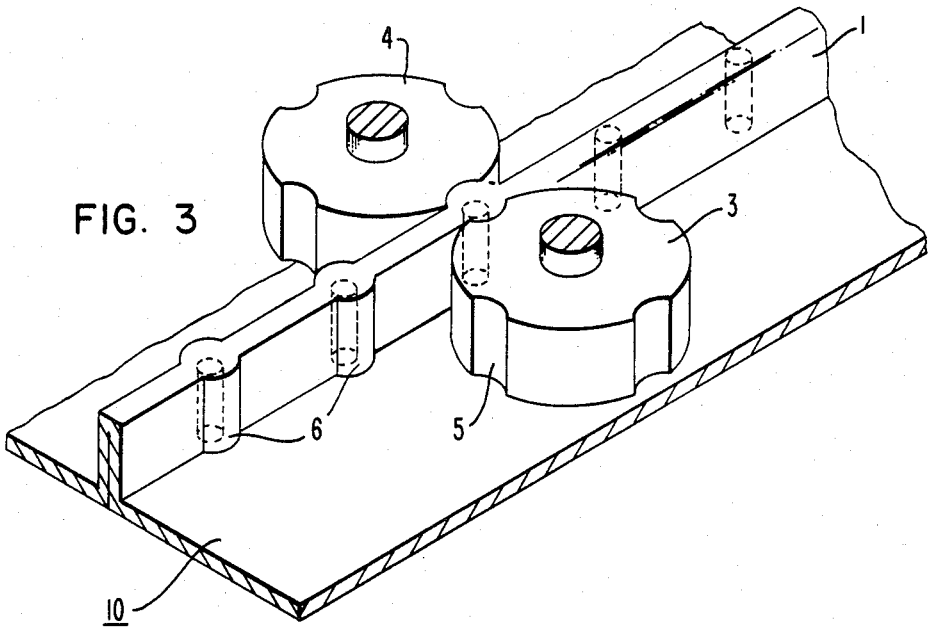
FIG. 3 illustrates the third step.

FIG. 3 illustrates the third step which consists of crimping or roll forming the loop segment 1 of the sheet metal 10 around the inserted pins 2 with rollers 3 and 4 having notches 5 which cooperate to close the looped sheet metal around the removable pins and form screw hole portions 6 at predetermined spaced intervals along the crimp-closed sheet metal loop segment 1.

Figure 4:
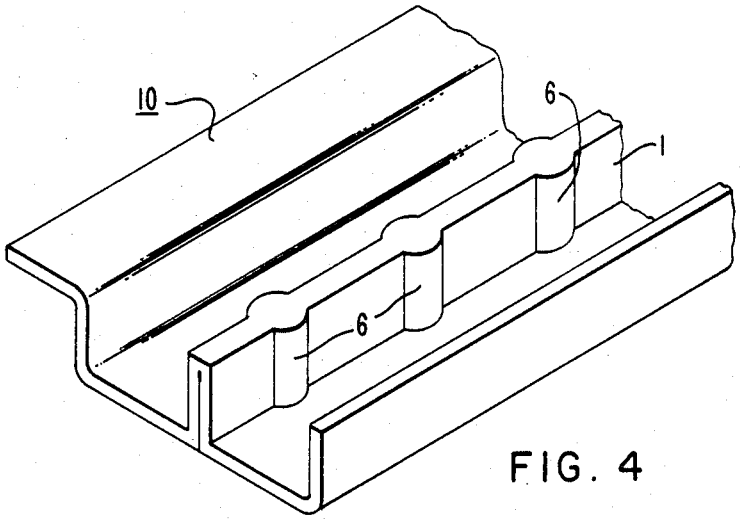
FIG. 4 illustrates the fourth step.

FIG. 4 illustrates the fabricated sheet metal 10 having the elongated loop segment 1 with the roll formed screw hole portions 6 provided therein after the pins 2 have been removed.

Although there has been illustrated and described a specific embodiment, it will be understood that such embodiment was chosen merely for purposes of illustration and that changes and modifications may be readily made therein by those skilled in the art without departing from the spirit and scope of this invention.

I claim:

1. A method of providing a simulated hole in sheet metal that is adapted to receive and serve as an anchorage means for a screw type fastener, which method comprises:

(a) roll forming an upstanding U-shaped loop segment of a predetermined depth in the sheet metal to match the length of a selected size of said fastener, said loop segment having a closed end and being wider than the diameter of the selected fastener;

(b) inserting a removable pin inside the loop segment at a medial position therealong where the simulated screw hole is desired and orienting the pin so that the inserted end faces the closed end of the U-shaped loop segment;

(c) crimping the loop segment of the sheet metal to close the metal around the removable pin and also close the parts of said loop segment that are adjacent to and located on either side of the pin; and then (d) removing the pin from the sheet metal loop segment to thereby provide the desired simulated hole and fastener-anchoring means in the sheet metal.

2. The method of claim 1 wherein;

said sheet metal is initially substantially flat, and said removable pin is of cylindrical configuration and the produced simulated hole is thus substantially circular in cross-section.

3. The method of claim 1 wherein;

the width of the U-shaped loop segment is such that the loop segment extends a predetermined distance along the sheet metal in continuous fashion, a plurality of pins are removably inserted into the elongated loop segment at predetermined spaced intervals therealong where simulated anchorage holes are desired, and the crimping operation closes the portions of the loop segments that are disposed between the respective pins and beyond the outermost pins so that a series of spaced simulated anchorage holes are formed in the sheet metal.

4. The method of claim 3 wherein the crimp-closing operation is performed by passing the elongated loop segment of the sheet metal between a pair of opposing rollers having notches in their work surfaces which cooperate with one another to close the metal around the respective removably inserted pins as said loop segment passes through the rollers.

* * * * *